United States Patent [19]

Solomon

[11] 4,126,062

[45] Nov. 21, 1978

[54] TORQUE WRENCH

[75] Inventor: Donald F. Solomon, Newport Beach, Calif.

[73] Assignee: JO-Line Tools, Inc., Anaheim, Calif.

[21] Appl. No.: 827,627

[22] Filed: Aug. 25, 1977

[51] Int. Cl.[2] ..... B25B 0/00

[52] U.S. Cl. ..... 81/52.4 R

[58] Field of Search ..... 81/52.4 R, 52.4 A, 52.5

[56] References Cited

U.S. PATENT DOCUMENTS

| | | | |
|---|---|---|---|
| 3,270,594 | 9/1966 | Grabovac | 81/52.5 |
| 3,772,942 | 11/1973 | Grabovac | 81/52.5 |

*Primary Examiner*—James L. Jones, Jr.

*Attorney, Agent, or Firm*—Fulwider, Patton, Rieber, Lee & Utecht

[57] ABSTRACT

A torque wrench is provided with a unique interconnection between the hinge, pivot and plunger. Both the hinge and plunger are channeled entirely across the width of their interfaces with the pivot normal to the plane of application of torque. A pivot retainer is provided to laterally constrain movement of the pivot. The pivot retainer may take the form of a flat disk with a rectangular aperture centrally located therein, it may be embodied in restraining pins extending transversely across the channel in the plunger face or it may include an axial guide rod extending through the plunger to engage and restrain the pivot.

8 Claims, 12 Drawing Figures

Fig. 1
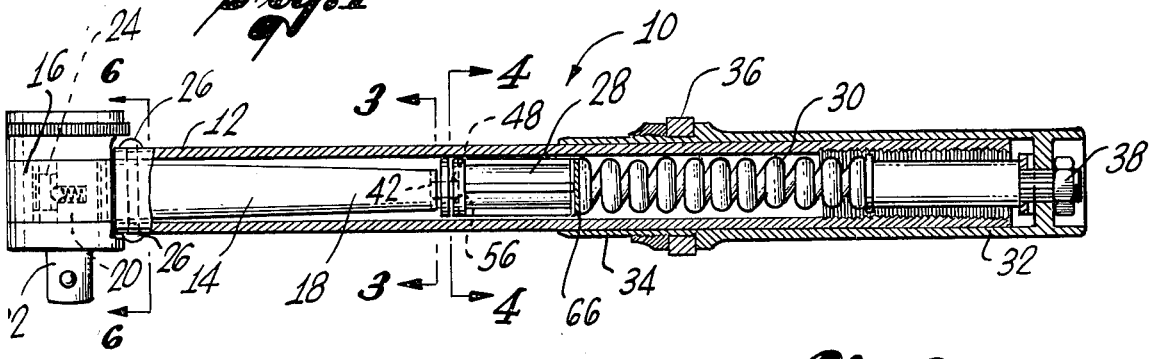
Fig. 2
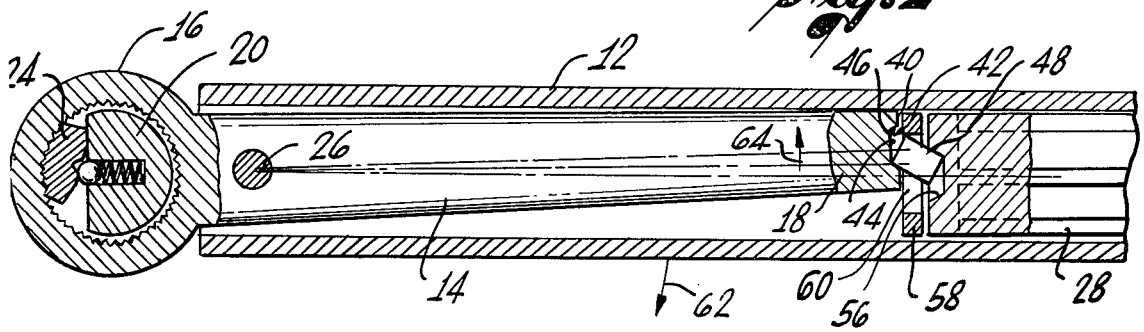
Fig. 3
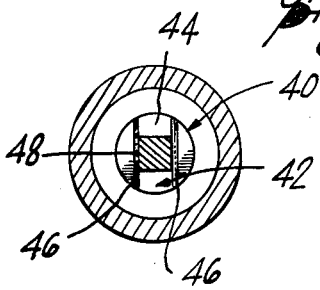
Fig. 4
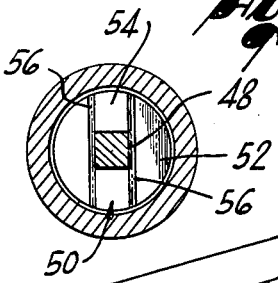
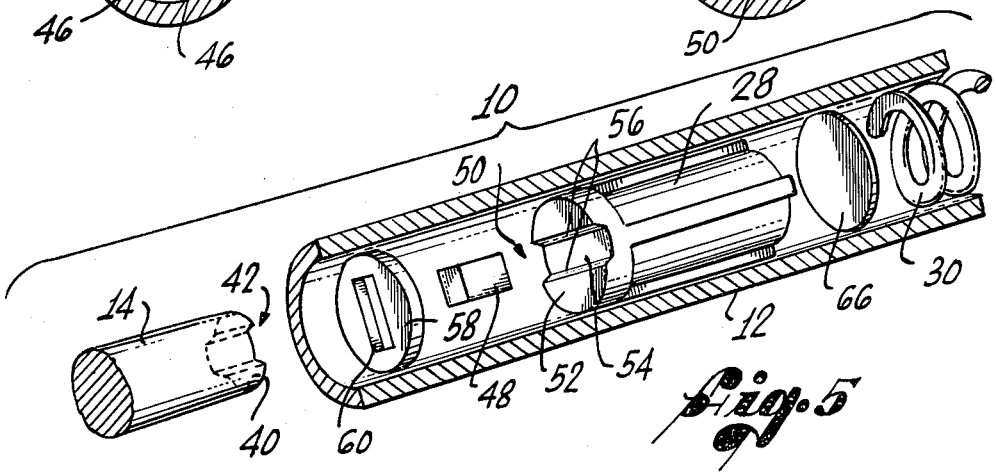
Fig. 5

TORQUE WRENCH

FIELD OF THE INVENTION

The present invention relates to mechanical torque wrenches and to torque limited, force transmitting devices.

BACKGROUND OF THE INVENTION

In conventional practice, torque wrenches are provided with a hinge, a pivot and a plunger aligned in that order within a tubular lever arm. The hinge fits loosely within the tubular lever arm and is rotatably mounted therein near one end of the lever arm about a mounting pin extending normal to the plane of application of torque. The hinge is connected to engage and rotate a workpiece at a connection proximate to the mounting pin. A coil spring, compressed to an adjustable degree, exerts a predetermined force on the plunger which transmits this force toward the hinge through the pivot which is interposed therebetween. The axial force of the coil spring maintains the plunger, pivot and hinge all in axial alignment within the tubular lever arm until a predetermined limit of torque is applied to the lever arm. This limit is determined by the degree of compression of the coil spring which may be altered by a calibrated adjustment mechanism. When the maximum torque limit is reached, the workpiece transmits sufficient resistance to the hinge, opposing further rotation, so that the continued application of torque ceases to rotate the hinge with the lever arm, but instead causes an angular rotation of the pivot within the lever arm, allowing the lever arm to rotate until the hinge contacts its interior wall. The shifting of the pivot creates a momentary reduction of resistance to the applied torque which can be felt by the operator, thus providing a signal that the upper limit of torque has been reached.

In conventional torque wrenches the pivot is typically formed in the shape of a rectangular prism. Recesses in both the hinge and plunger accommodate the pivot and allow it to tip to accommodate the shifting of the lever arm relative to the hinge bringing the hinge in contact with the interior wall of the encasing lever arm once the predetermined limit of torque has been reached. The recesses in the opposing facing surfaces of the plunger and the hinge are centrally located along the torque wrench lever arm axis. The recesses take the form of centered depressions formed with a flat floor parallel to and recessed from the respective surface in which the depressions are created. The walls of the depressions are inclined outwardly in the surfaces in which they are formed in the direction in which torque is applied. Normal to this direction, the walls of the depression are formed at right angles to the opposing hinge and plunger surfaces. This construction permits the pivot to tip when a maximum allowable torque is applied, but prevents movement of the pivot normal to the direction of application of torque. A peripheral surface area of the faces of both the plunger and hinge members lies between the edges of the centralized depressions therein and the boundary perimeters of the plunger and hinge members. The reason that centralized depressions are employed in both the hinge and plunger members of a conventional torque wrench is to ensure that the pivot is always trapped in the depressions to lie along the longitudinal axis of the lever arm of the torque wrench.

The manufacture of hinge and plunger members with central depressions is extremely difficult. The machining required to create central depressions of square cross section in the opposing faces of the plunger and hinge members requires an imprintation process to deform the metal of the plunger and hinge by striking those members sharply and with considerable force to deform the metal. Since both the plunger and hinge are formed of hardened steel, extremely heavy and expensive impact machinery is required to achieve the necessary indentations in the plunger and hinge faces. Even so, with conventional impact hammers, a depression of only about 0.030 inches in depth is achieved in the faces of the plunger and hinge members. This creates a very narrow bearing surface against which torsional forces are transmitted through the pivot. As a result, pressure on the pivot, especially at the corners is extremely high and the pivots of conventional torque wrenches do tend to deteriorate with use, and hence have a shortened life.

It is an object of the present invention to provide an improved torque wrench which is easy to manufacture and which has a greater useful life than conventional torque wrenches. This is achieved by milling a channel across the entire width of the opposing faces of the plunger and hinge members. The channels replace the centralized depressions which would otherwise be necessary, and thereby eliminate the imprintation process entirely in the manufacture of torque wrenches. The pivot is retained centralized along the torque wrench axis and is prevented from sliding laterally within the channels by a pivot retaining mechanism, which may take one of several forms. A disk with a rectangular aperture therein having an outer diameter to snugly fit within the hollow lever arm of the torque wrench ensures that the pivot remains centralized along the torque wrench axis. Alternatively parallel pins may be anchored to the plunger or hinge member to extend transversely across the channel formed therein. The pins are separated by a distance sufficient to accommodate the torque wrench pivot. Force transmitted to the pivot may cause the pivot to bear against the transverse pins, which serve to confine the pivot in the center of the channel to maintain it in a position centered on the torque wrench axis. Yet a further form of the invention permits an axial guide rod to extend longitudinally through the plunger to engage and restrain lateral movement of the pivot.

With all of the foregoing embodiments, the pivot is laterally immobilized against movement in the direction normal to the plane of application of torque, but the pivot is allowed sufficient latitude in the plane of application of torque so that it can tip once the predetermined upper limit of force has been reached.

Another object of the invention is to reduce the rattling noise of the pivot within the torque wrench. In conventional torque wrenches, the pivot is entrapped loosely between the two centralized depressions in facing surfaces of the hinge and the plunger. When the wrench is not subjected to torsion, the pivot rattles within its confines as the wrench is moved about. Such rattling is undesirable, as it gives the impression to the user that the tool is worn or somehow defective. In the embodiment of the present invention in which a disk with a central rectangular aperture is provided as the pivot retaining mechanism, the aperture in the disk may be formed with a punch press. This creates fenders or shoulders at the edges of the aperture which fit snugly against the pivot, yet which are cantilevered sufficiently to defect so as not to inhibit the pivot in its angular rotation relative to the hinge and the plunger. By holding the pivot immobile even when the torque wrench is not in use, this embodiment of the invention prevents the pivot from rattling within the torque wrench, thereby eliminating a source of concern to the user.

Yet another embodiment of the invention reduces wear on the plunger. During the course of use, the plunger reciprocates repeatedly within the tubular lever arm housing the hinge, the pivot and the plunger in order to accommodate the movement of the pivot. In conventional torque wrenches, the plunger is manufactured of steel as is the tubular housing. Thus, a recurring wearing of steel against steel results with the possibility that the housing will become gouged or deformed by the plunger over a period of time. Such deformation causes the torque wrench to misfunction and for the plunger to fail to reciprocate when the predetermined limit of torque has been reached should it catch in a crease or area of scoring in the wall of the housing. According to one of the embodiments of the present invention, however, the plunger is formed with a central axial guide rod which terminates near the hinge in a collar or sleeve of a low friction material, such as brass or scintered bronze. By creating the plunger of such a low friction material, scoring and deformation of the interior walls of the tubular lever arm is avoided, thereby preventing catching or other irregularities of movement of the plunger within the lever arm.

DESCRIPTION OF THE DRAWINGS

FIG. 1 is an elevational sectional view of one embodiment of the invention.

FIG. 2 is a plan sectional view of a portion of the embodiment of FIG. 1.

FIG. 3 is a cross sectional view taken along the lines 3—3 of FIG. 1.

FIG. 4 is a cross sectional view taken along the lines 4—4 of FIG. 1.

FIG. 5 is an exploded view of the hinge-pivot-plunger interconnection of the embodiment of FIG. 1.

DESCRIPTION OF THE EMBODIMENTS

Figure 6:
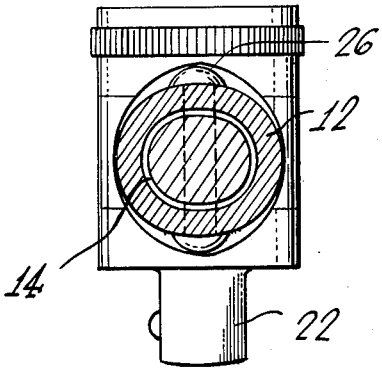
FIG. 6 is an cross sectional view taken along the lines 6—6 of FIG. 1.

With reference to FIGS. 1 and 5 to a torque wrench 10 is illustrated having a hollow tubular lever arm 12 which serves as a housing for a number of other components of the torque wrench 10. Axially aligned within the lever arm 12 are a hinge 14, a pivot 48, a plunger 28 and a coil spring 30. In addition, a pivot retainer 58 is provided to shackle the pivot 48 to prevent it from moving lengthwise along the channels 42 and 50 formed in the facing end surfaces 40 and 52 respectively of the hinge 14 and the plunger 28.

The elongated hinge 14 is located within the hollow arm 12 and is formed as a solid rod terminating in a laterally disposed annular ring 16 at its enlarged end, illustrated in FIG. 2. The hinge 14 is of generally eliptical cross section adjacent the annular ring 16, as depicted in FIG. 6. The hinge 14 is tapered to an approximate circular cross section at a relatively slender end 18.

The laterally disposed annular ring 16 depicted in FIG. 2 is equipped with radially interiorally directed ratchet teeth which interlock with and carry a transversely disposed load engaging lug 20 which has a downwardly extending drive pin 22 of square cross section, depicted in FIGS. 1 and 6. The mating ratchet teeth of the annular ring 16 and the lug 20 are engaged and disengaged by the action of a spring pawl 24 in a conventional manner as illustrated in FIG. 2. The hinge 14 is rotatably connected within the tubular lever arm 12 by a mounting pin 26 extending through the lever arm 12 and hinge 14 parallel to the load engaging lug 20 of FIG. 1 to allow limited rotation of the slender end 18 of the hinge within the confines of the lever arm 12.

As illustrated in FIGS. 1 and 5, the plunger 28 is spring biased toward the slender hinge end 18 by a coil spring 30 which is directed against bearing disk 66 and is compressed to an adjustable degree by relative advancement of the concentric tubular handle 32 along the outer threaded surface of the calibrated collar 34 which is attached to the tubular lever arm 12. A knurled ring 36 trapped within the handle 32 allows finger adjustment of compression on the coil spring 30 which is attached to the handle 32 by a lock nut 38.

The slender end 18 of the hinge 14 terminates in a surface 40 perpendicular to the hinge axis. A channel 42 is milled across the entire width of the face 40 to have a flat floor 44 with inclined walls 46 as depicted in FIGS. 2 and 3. The channel 42 is oriented normal to the direction of elongation of the hinge 14 and remote from the drive pin 22 and transversely oriented relative to the plane of application of torque to the lever arm 12 in perpendicular arrangement as depicted in FIGS. 1 and 2.

A pivot block 48 in the shape of a rectangular prism oriented along the axis of the tubular lever arm 12 is normally disposed in seated arrangement in the channel 42 of the slender end 18 of hinge 14 in the position depicted in FIG. 1. The plunger 28 also receives the pivot 48 in a channel 50 in an opposing end surface 52 which faces the surface 40 of hinge 14. The channel 50, like the channel 42, is milled across the entire width of face 52 and has a flat floor 54 with outwardly inclined walls 56 rising therefrom, as illustrated in FIGS. 2 and 4. The channel 50 likewise is transversely oriented, preferably perpendicular, to the plane of application of torque to the lever arm 12. Because both the channels 42 and 50 can be milled into the mutually facing surfaces of the hinge 14 and plunger 28, they can be formed much deeper than the recesses normally imprinted into the opposing hinge and plunger faces in conventional torque wrenches. While imprinted recesses of conventional torque wrenches normally are limited to a depth of about 0.030 inches, the channels 42 and 50 are preferably milled to a depth of 0.070 inches, so that the inclined walls thereof provide a much greater bearing surface to act on the pivot 48 in transmitting force.

A pivot retaining mechanism in the form of a disk 58 with a rectangular aperture 60 therein is illustrated in FIG. 5 and serves as a guide for the pivot 48 which lies shackled therewithin with one end normally seated flush against the floor 44 of channel 42 in hinge 14 and with the other end normally seated flush against the floor 54 of channel 50 in plunger 28.

The biasing compression spring 30 may be adjusted by advancement of the handle 32 toward or away from the workpiece engaging pin 22 to push against a bearing disk 66 to exert a predetermined biasing force to urge the plunger 28 and the pivot 48 toward the hinge 14 to maintain the pivot 48 in the seated position in the channels 42 and 50. However, rotation of the lever arm 12 with torque exceeding a predetermined limit in either direction in the plane of FIG. 2 to work against a load at the load engaging pin 22 of FIG. 1 will cause the pivot 48 to tilt to the position of FIG. 2.

With reference to FIG. 2, for example, if the lever arm 12 is rotated clockwise in the direction of the arrow 62, it will carry with it the hinge 14 in the axially aligned position of FIG. 1 until the upper limit of torque has been reached. When this occurs, the resistance of the load on the load engaging pin 22 acts in opposition to rotation of the lever arm 12 in the direction indicated by the counterclockwise arrow 64 in FIG. 2. At the predetermined upper limit of torque on the lever arm 12, the resisting force acting at 64 is sufficient to hold the hinge 14 in position despite rotation of the lever arm 12. Lever arm 12 then proceeds in rotation a short distance until its interior wall contacts the hinge 14 at the slender end 18. Since the plunger 28 is not allowed the latitude of movement of the hinge 14 within the lever arm 12, this rotation of the lever arm 12 can only be achieved by tipping or rotating the pivot 48 to the position of FIG. 2. This angular rotation of the pivot 48 forces the plunger 28 axially back away from the load engaging lug 20, overcoming the bias of the compression spring 30. Tilting of the pivot 48 occurs with an audible click as the pivot tips and the surfaces thereof meet with the inclined walls 46 and 56 of the channels 42 and 50 respectively. At the same time, rotation of the lever arm 12, which to that point could occur only by overcoming a large resistance, is suddenly faciliated for a short distance as the pivot 48 gives way and tips. The torque wrench operator is thereby signaled that the predetermined upper limit of torque has been reached.

The pivot 48 is prevented from turning completely sideways or from becoming dislodged from the channels 42 and 50 by virtue of the apertured pivot retaining disk 58 depicted in FIG. 5. It should be noted that the longer dimension or major axis of the rectangular aperture 60 lies in a direction perpendicular to the orientation of the load engaging pin 22 and parallel to the plane of application of torque. This allows the pivot 48 to tip to the requisite degree as indicated in FIG. 2. The lateral restraint imposed upon the pivot 48 by the shorter rectangular dimension of the aperture 60 along the minor axis thereof serves to trap the pivot 48 within the pivot retainer 58 and limits its lateral excursion along the channels 42 and 50 within the confines of the lever arm 12.

By employing the channels 42 and 50 which extend entirely across the facing surfaces of hinge 14 and plunger 28 respectively in conjunction with the retaining disk 58 as depicted in FIG. 5, the necessity for imprinted recesses in the hinge and plunger is avoid entirely. As previously noted, this facilitates manufacture of the torque wrench 10 considerably, thereby sharply reducing its cost. Also, because it is possible to mill channels 42 and 50 in the hinge 14 and plunger 28 to a depth much greater than is obtainable with imprinted recesses, a greater bearing surface is provided on the inclined walls 46 and 56 of the channels 42 and 50 respectively. This increased bearing surface reduces the concentration of force on the edges of the pivot 48, thereby reducing degradation of this component and increasing the useful life of the torque wrench 10.

Figure 7:
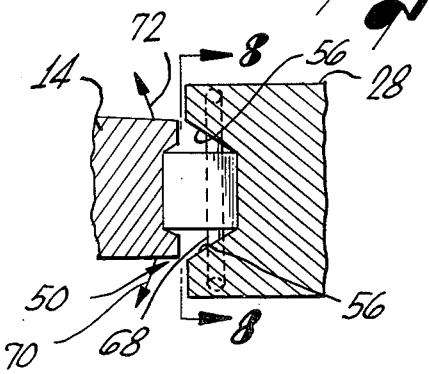
FIG. 7 is a plan sectional view showing a portion of an alternative embodiment of the invention.
Figure 8:
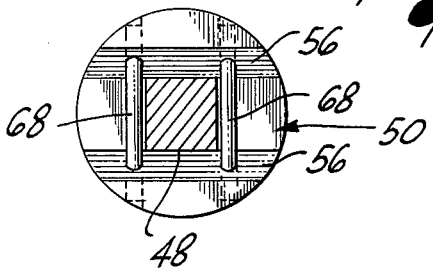
FIG. 8 is a cross sectional view of the embodiment of FIG. 7 taken along the lines 8—8 of FIG. 7.

Alternative embodiments of the invention to that depicted in FIGS. 1–6 are also possible. For example, FIGS. 7 and 8 illustrate a different form of pivot retainer in which a pair of parallel brass pins 68 are positioned on either side above and below the pivot 48 between the hinge 14 and the plunger 48. The brass pins 68 extend normal to the alignment of the channel 50 in the end surface 52 of the plunger 28. The brass pins are inserted through laterally extending transverse apertures above and below the pivot 48 entirely through the plunger 28, and are immobilized therein within the confines of the tubular lever arm 12. The brass pins 68 thereby prevent movement of the pivot 48 along the length of the channel 50, and so maintain the pivot 48 along the center line of the lever arm 12. It should be noted that the pivot 48 is still free to tip laterally in the directions of application of torque indicated by the arrows 70 and 72 in FIG. 7. That is, the pivot may still assume a position of angular rotation inclined against either of the sloping walls 56 of the channel 50 in the plunger 28, in a manner similar to that depicted in FIG. 2.

Figure 9:
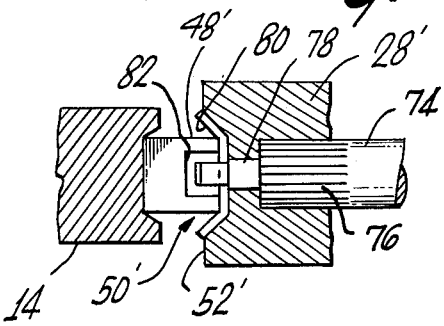
FIG. 9 is a plan sectional view showing a portion of another alternative embodiment of the invention.

The embodiment of FIG. 9 includes a pivot retainer in the form of an axial guide rod 74 having a knurled end 76 directed toward the workpiece and to which the plunger 28' is fitted in locking engagement. The plunger 28' has an axial bore of stepped down diameter to receive the end 76 of the guide rod 74 and also to receive the guide pin 78 which extends to the transverse surface 52' of the plunger 28' in which the channel 50' is formed. The guide pin 78 extends into a cylindrical cavity 82 formed in the surface of the pivot 48' which is directed toward the channel 50'. The pivot 48' rests in contact with a concave trough 80 formed of steel and residing in contact and in geometric conformity with the channel 50'. The cavity 82 in the pivot 48' is of a sufficient diameter so that the pivot 48' can tilt or tip relative to the guide pin 78, yet will still be held in place by the guide pin 78 along the central axial alignment of the plunger 28'.

Figure 10:
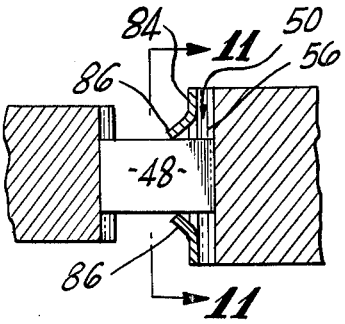
FIG. 10 is a side elevational sectional view showing a portion of another alternative embodiment of the invention.
Figure 11:
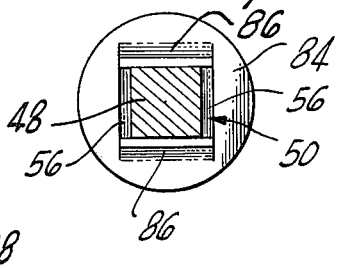
FIG. 11 is an elevational cross sectional view taken along the lines 11—11 of FIG. 10.

The embodiments of FIGS. 10 and 11 illustrate a pivot retainer 84 which is similar in many respects to the pivot retainer 58 of FIGS. 1 through 6. However, the pivot retainer 84 is formed from a disk perforated at the center by punch press employing a rectangular die which forms edges 86 at the perforation that are inwardly inclined and laterally extending parallel to the direction of application of force on the die. The inwardly extending cantilevered edges 86 reside in contact with the pivot 48 but are sufficiently flexible so that the pivot 48 can tip to assume a position in contact with either one of the inclined surfaces 56 of the channel 50. By riding in contact with the pivot 48, however, the edges 86 prevent the pivot 48 from rattling within the torque wrench 10. A rattling noise, such as frequently occurs in connection with conventional torque wrenches by virtue of movement of the pivot therein, is a source of annoyance to the user and gives rise to a concern that the wrench is misadjusted or worn to a considerable degree. By removing the undersireable rattling noise the present invention obviates this concern.

Figure 12:
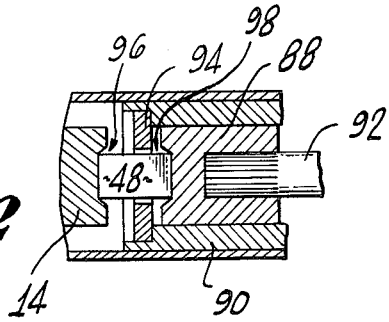
FIG. 12 is a plan sectional view showing a portion of another alternative embodiment of the invention.

Another alternative embodiment of the interconnection between the plunger and the hinge 14 is depicted in FIG. 12. In this embodiment an annular hardened steel core 88 of the plunger is of a considerably smaller diameter than the interior diameter of the surrounding tubular lever arm 12. The intervening space therebetween is occupied by an annular sleeve 90 formed of a low friction material, such as brass or scintered bronze. In conventional torque wrenches, the continuous wearing of a plunger against the surrounding tubular lever arm and the reciprocation thereof resulting from tilting of the pivot 48 often results in scoring or scratching of the interior walls of the lever arm 12. By providing a surrounding sleeve 90 formed of low friction material about the plunger 88, such scratching or scoring is all but eliminated. Rather, when excessive stress between the sleeve 90 and the surrounding interior wall of the lever arm 12 occurs, the sleeve 90 will be slightly deformed, rather than the interior wall of the lever arm. Such deformation is not particularly harmful, at least to the degree likely to occur by the mere reciprocation of the plunger 88 and sleeve 90 within the lever arm 12.

The plunger 88 is keyed to the knurled end of an axial guide rod 92 which extends toward the end of the torque wrench remote from the workpiece. A disk 94 with a rectangular hole therein, similar to the disk 58 of FIG. 5, is interiorally disposed in set back relationship from the hinge 14 within a circular bore to rest on an interior transverse annular ledge in the sleeve 90. Channels are formed in the hinge 14 and in the plunger core 88 as indicated at 96 and 98 respectively. The pivot 48 resides in contact with these channels, alternating between the seated position depicted in FIG. 12 and a tipped or tilted position, such as that depicted in the embodiment of FIG. 2.

It will be appreciated that numerous other variations, modifications, and alternative embodiments of the invention are possible and are contemplated by the fundamental concept of the present invention. Accordingly, the invention should not be construed as limited to the specific embodiments depicted and disclosed herein, as these embodiments are intended to be exemplary only. Rather, the invention described is defined in the claims appended hereto.

I claim:

1. A torque wrench comprising:

a hollow tubular lever arm;

an elongated hinge member housed within said hollow lever arm and carrying a load engaging means at one end thereof; and rotatably connected to said tubular lever arm proximate thereto, whereby torque can be applied from said lever arm to said load engaging means, and said hinge member has a channel with inclined walls formed across the full width of an end surface thereof running normal to the direction of elongation and located remote from said load engaging means and said channel is transversely oriented relative to the plane of application of torque a pivot positioned within said tubular lever arm and shaped in the form of a rectangular prism and adapted for movement between a seated position in said channel and a position angularly displaced from said seated position;

a plunger member positioned within said tubular lever arm and formed with an end surface perpendicular thereto with a channel defined therein transversely oriented relative to the plane of application of torque and extending the full width of said end surface at the end thereof nearest said load engaging means and arranged to receive said pivot, biasing means anchored relative to said tubular lever arm and positioned to resiliently bias said plunger member toward said load engaging means to urge said pivot toward said seated position with a predetermined force; and pivot retaining means positioned within said tubular lever arm to define lateral constraints to inhibit movement of said pivot normal to the plane of application of torque.

2. The torque wrench according to claim 1 wherein said pivot retaining means is a disk with a rectangular aperture defined therein positioned within said tubular lever arm and normal thereto between said hinge member and said plunger and shackling said pivot and limiting the lateral excursion thereof along said channels within the confines of said lever arm.

3. The torque wrench according to claim 2 wherein said rectangular aperture is defined with a major axis perpendicular to the plane of application of torque and with a minor axis lying in the plane of application of torque.

4. The torque wrench according to claim 1 wherein said pivot retaining means is comprised of parallel pins positioned on either side of said pivot between said hinge and said plunger and extending normal to the alignment of said channel in said end face of said plunger member and locked in position relative thereto.

5. The torque wrench according to claim 1 wherein said pivot retaining means is a disk positioned between said hinge and said plunger with a rectangular perforation defined therein and with edges at said perforation inclined toward said hinge and against which said pivot moves in contact.

6. The torque wrench according to claim 1 wherein said pivot retaining means comprises an axial guide rod extending longitudinally through said plunger into engagement with said pivot to hold said pivot in said channel defined in said end face of said plunger.

7. The torque wrench according to claim 6 wherein said plunger is comprised of an axial guide rod and an annular sleeve located thereabout and formed of low friction material.

8. The torque wrench according to claim 1 wherein said plunger is comprised of an axial guide rod, a surrounding annular core with said channel of said plunger defined therein, and a surrounding annular sleeve disposed about said core and coupled thereto to carry said pivot retaining means.

* * * * *